US007175497B2

(12) United States Patent
Herzog

(10) Patent No.: US 7,175,497 B2
(45) Date of Patent: Feb. 13, 2007

(54) APPARATUS OPERABLE FOR TRANSFORMATION BETWEEN A PURSE AND A TOY

(76) Inventor: Shelagh Herzog, 233 E. 18th St., New York, NY (US) 10003

( * ) Notice: Subject to any disclaimer, the term of this patent is extended or adjusted under 35 U.S.C. 154(b) by 0 days.

(21) Appl. No.: 11/046,981

(22) Filed: Jan. 31, 2005

(65) Prior Publication Data

US 2006/0172652 A1 Aug. 3, 2006

(51) Int. Cl.
*A63H 3/52* (2006.01)
*A63H 3/00* (2006.01)

(52) U.S. Cl. ..... 446/71; 446/74; 190/2; 5/655; 383/4; 150/103

(58) Field of Classification Search ..... 446/71–76; 150/106, 103, 107; 383/4, 72, 75; 190/1; 5/94, 93.1
See application file for complete search history.

(56) References Cited

U.S. PATENT DOCUMENTS 665,942 A * 1/1901 Tabler ..... 383/74
2,212,390 A * 8/1940 Conklin ..... 383/2
2,454,013 A * 11/1948 Scherzinger ..... 383/2
4,204,361 A * 5/1980 Chaput ..... 446/74
4,717,056 A * 1/1988 Carmichael ..... 224/158
4,977,941 A * 12/1990 Henderson ..... 150/112
5,819,341 A * 10/1998 Simantob et al. ..... 5/98.1
6,145,932 A * 11/2000 Hamel-Nyhus et al. ..... 297/465
2002/0125747 A1* 9/2002 Drost et al. ..... 297/184.13

* cited by examiner

*Primary Examiner*—Eugene Kim
*Assistant Examiner*—Urszula M. Cegielnik
(74) *Attorney, Agent, or Firm*—Vinson & Elkins, LLP

(57) ABSTRACT

A purse that converts into a doll bed, having an upwardly facing basket; fabric mounted in the basket and which extends upwardly from the basket to form an upwardly facing container that may serve as either a purse or a doll bed; straps secured to the upper end of one of the fabric or the basket so that the combination purse and doll bed may be readily carried; the fabric of the purse extends upwardly sufficiently so that the fabric may form a purse or be folded outwardly to form a doll bed; and a fabric hood secured to the interior of the fabric which may lay concave when the fabric is formed into a purse or be lifted to serve as a toy sunshade for a doll when the fabric is formed into a doll bed.

2 Claims, 3 Drawing Sheets

APPARATUS OPERABLE FOR TRANSFORMATION BETWEEN A PURSE AND A TOY

BACKGROUND OF THE INVENTION

1. Field of the Invention

The present invention relates to an apparatus that is operable for transformation between a purse and a toy. The apparatus coverts into a doll bed or bassinet which includes a fabric hood which may lay concave when the apparatus is formed into a purse or be lifted to serve as a toy sunshade for a doll when the apparatus is formed into a doll bed or bassinet. It is believed that the field of the invention includes Design Class 6, subclasses 383, 390 and 391; and Design Class 21, subclass 520; and Utility Class 5, subclasses 93.1, 93.2, 98.1, 98.3, 101, 103, 120, 122, 123 and 655; and Utility Class 150, subclasses 100, 103 and 105; Utility Class 294, subclasses 140 and 141; Utility Class 383, subclass 117; and Utility Class 446, subclasses 71, 73, 74, 76, 227, 268, 482 and 491.

2. Description of the Related Art

A number of accessories are available to accentuate a person's appearance. One such accessory is a hand bag generally referred to as a purse. Purses are made available in an array of different colors, styles, and textures. A purse is typically utilized to store contents that the wearer may want during the course of a day. For example, a purse may be used to store money, lipstick, tissue, cell phones, or any other item the wearer may desire easy access to.

It is often the case that purses are purchased for children of various ages. For example, girls often desire to mimic the appearance of their mother, teacher, or other person they see making use of a purse. To satisfy this desire, parents often purchase purses for their daughters.

Conventional purses are typically one-dimensional in purpose. It would be desirable, therefore, to provide a multifunctional purse that may also serve, for example, as a play toy. The present invention is directed to an apparatus that is operable for transformation between a purse and a toy.

SUMMARY OF THE INVENTION

It is an object of this invention to provide an apparatus which may serve as a purse and as a bed for a doll. It is also an object of this invention to provide an apparatus that includes fabric or other suitable soft material which may be gathered and secured by a drawstring or similar device to form a purse or be folded inwardly to form a protective covering for the contents of a purse or a doll contained therewithin or be folded outwardly when the apparatus serves as an open doll bed. It is also an object of this invention to provide an apparatus which includes a fabric hood which may lay concave when the apparatus is formed into a purse or be lifted to serve as a toy sunshade for a doll when the apparatus is formed into a doll bed.

BRIEF DESCRIPTION OF THE DRAWINGS

The invention may be best understood by reference to the following description taken in conjunction with the accompanying drawings, in which like reference numerals identify like elements, and in which:

FIG. 1 is a perspective view of a purse that converts into a doll bed according to one illustrative embodiment of the invention, with the fabric material extended upwardly and closed through a draw string or the like.

Figure 1:
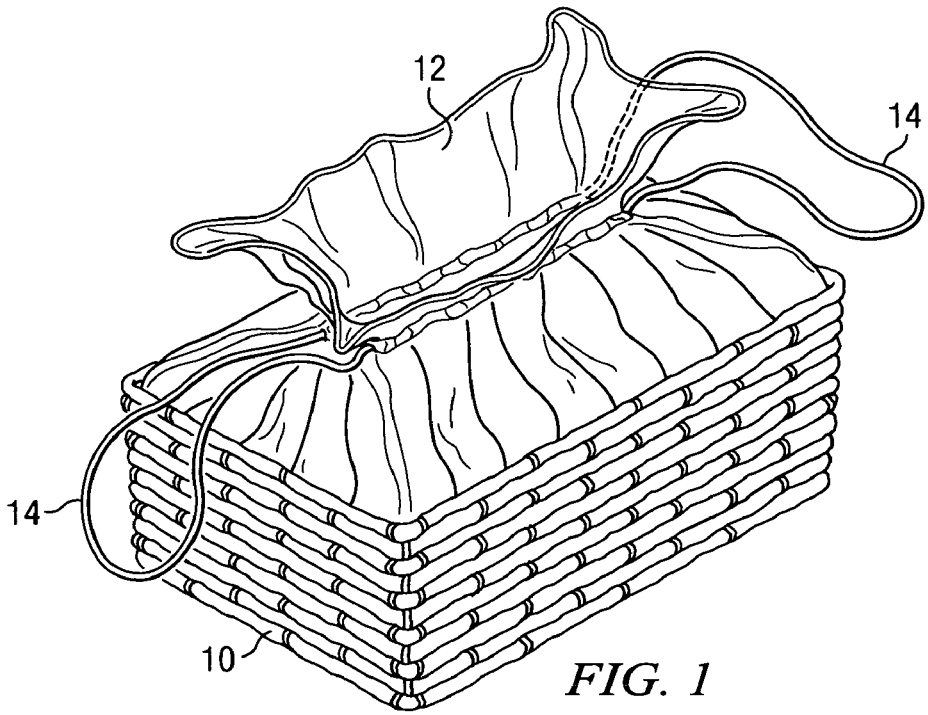

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring now to the Figures and in particular FIG. 1, there is shown an upwardly facing container 10. In FIG. 1, the upwardly facing container 10 is a wicker basket. However, it could be made of any suitable material that is substantial enough in construction to form the base of the purse that converts into a doll bed according to this invention. It could be constructed of heavy cloth material or made of paper or plastic.

As shown in FIG. 1, mounted within the upwardly facing container 10 is fabric 12 or other suitable material that forms the purse bag or pouch when the apparatus is used as a purse and forms the fabric skirt of the doll bed, crib or bassinet when the apparatus forms a doll bed, crib or bassinet. Preferably the fabric skirt is frilly and contains folds that are pleasing to little girls.

In the illustrative embodiment shown herein, the fabric is mounted within the wicker basket and extends throughout the entire inside of the wicker basket so that when the apparatus is used as a purse, the contents of the purse rest on the fabric and when the apparatus is used as a doll bed, the doll rests on the fabric. However, the fabric 12 could simply be connected to the top of the basket 10 whereby the contents of the purse or the doll rests on the wicker basket.

As shown in FIG. 1, mounted within or to the fabric in the vicinity of the top thereof is a draw string 14. The draw string is used to gather the fabric near its top and close the bag. The draw string could be located in many different locations, including at the very top of the bag. In the embodiment shown, the draw string is mounted a bit beneath the top of the bag so that when the bag is closed, there are picturesque frills and folds of the fabric above the draw string. In this illustrative example, the draw string also serves as the handle for the purse. However, there could be a separate handle for the purse connected to the basket.

Figure 2:
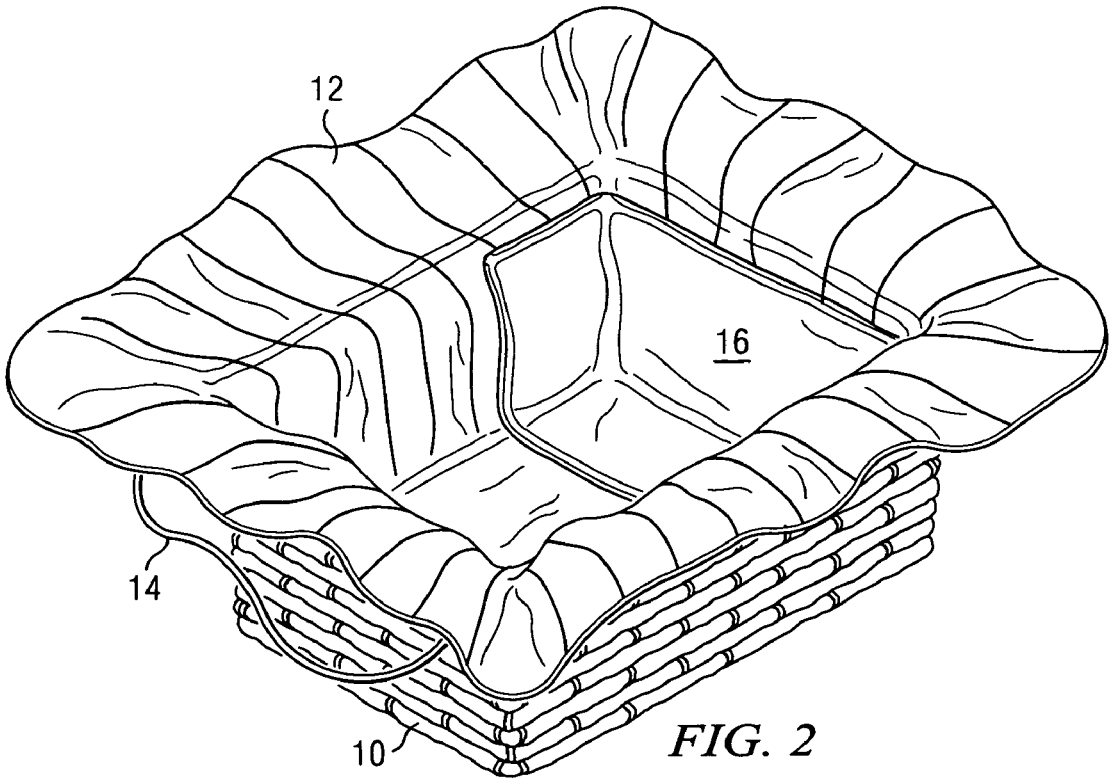
FIG. 2 is a perspective view of a purse that converts into a doll bed according to one illustrative embodiment of the invention, with the fabric material extended outwardly to allow easy access to the contents of the purse or to form a bed for a doll and with the fabric hood mounted therein laying concave along the end and bottom of the apparatus.

FIG. 2 shows the purse that may be converted to a doll bed according to one illustrative embodiment of the invention with the fabric 12 extending upwardly and folded outwardly to allow easy access to the contents of the purse or to form a bed for a doll. In this embodiment, in order to provide picturesque frills and folds of the fabric and to provide a more aesthetically pleasing outer portion of the doll bed bassinet when the apparatus forms a doll bed, extra cloth is provided at the top of the fabric 12 so that when the purse is opened, it flares outwardly. As will be discussed below, there is a semicircular fabric hood mounted within the apparatus along one end thereof. In FIG. 2 the fabric hood is laying concave along the end and bottom of the apparatus and cannot be seen. The design and construction of the fabric hood may be made such that, when placed in a concave position, the fabric hood aligns itself with interior shape of the purse.

Figure 3:
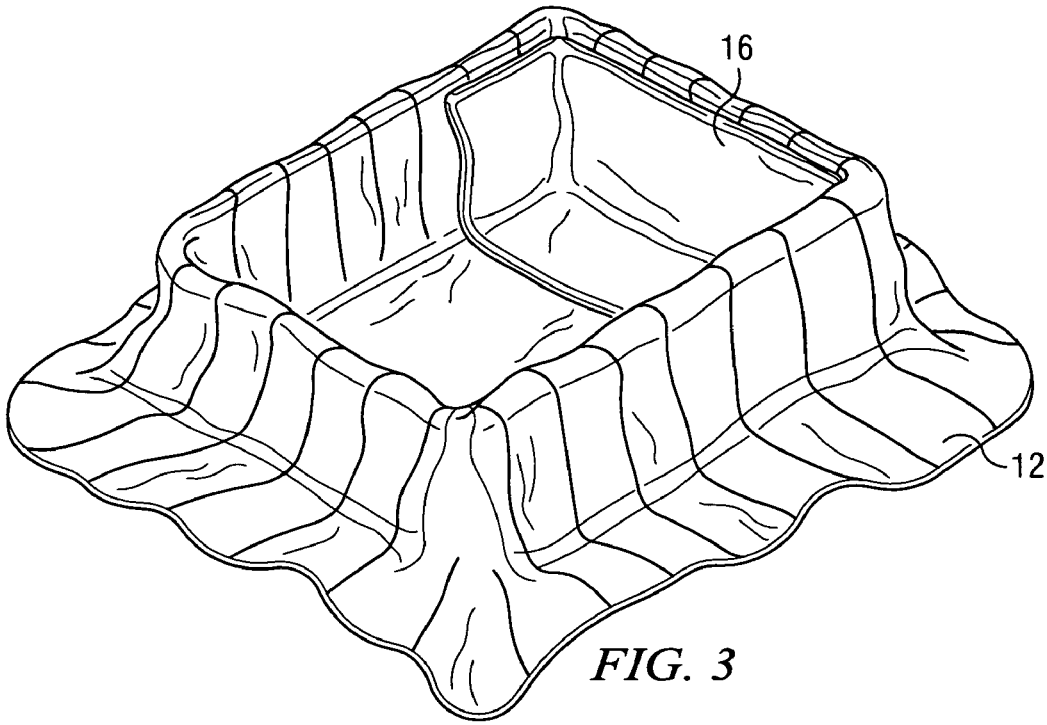
FIG. 3 is a perspective view of a purse that converts into a doll bed according to one illustrative embodiment of the invention, with the fabric material extended outwardly to form a bed for a doll and with the fabric hood mounted therein laying concave along the end and bottom of the apparatus.

FIG. 3 shows the purse that maybe converted to a doll bed according to this invention with the fabric 12 folded outwardly and downwardly around the container (the container cannot be seen in FIG. 3) along the to allow easy access to the contents of the purse or to form a bed for a doll. A semicircular hood 16 is mounted at one end and along a portion of the sides of the container 10. In FIG. 3, the fabric hood 16 is laying concave along the end and bottom of the container 10 and the concave inside of the apparatus is depicted as the area that is dotted.

Figure 4:
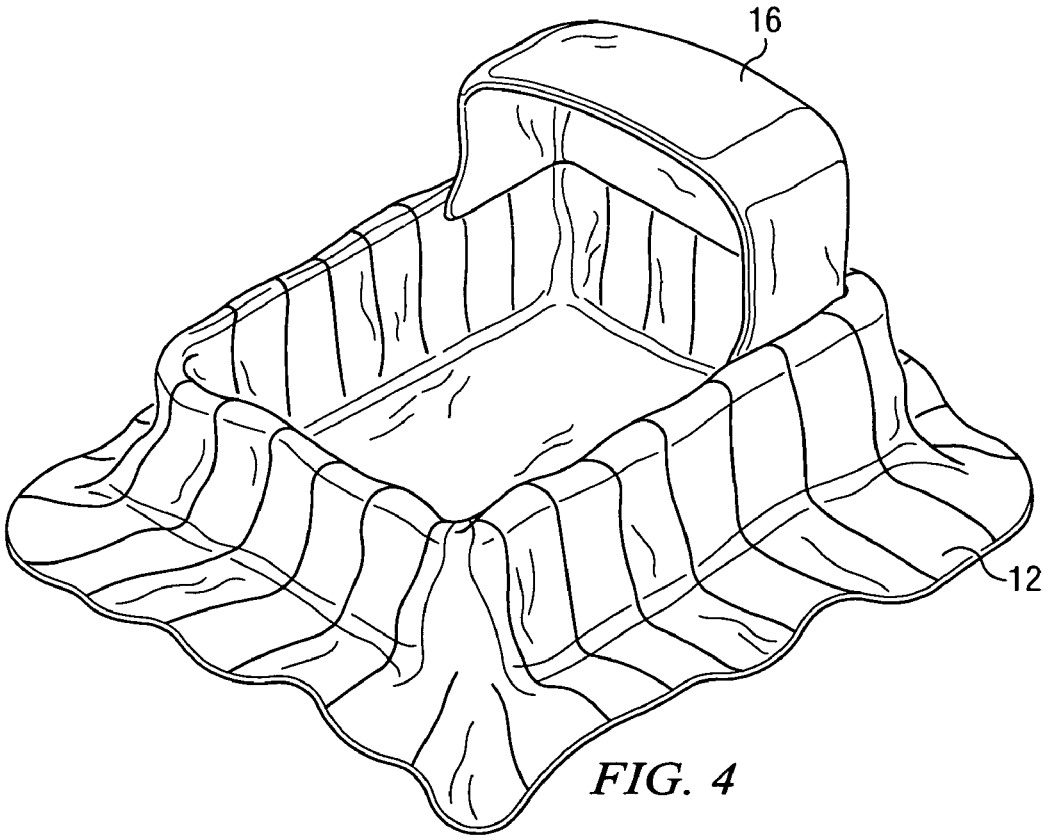
FIG. 4 is a perspective view of a purse that converts into a doll bed according to one illustrative embodiment of the invention, with the fabric material extended outwardly to form a bed for a doll and with the fabric hood mounted therein lifted to serve as a toy sunshade for the doll.

The hood 16 maybe constructed of a fabric substantial enough to hold its shape when lifted to serve as a toy sunshade for the doll. When the apparatus is used as a doll bed with the hood 16 lifted to serve as a toy sunshade for the doll, the apparatus constitutes a bed, crib or bassinet. FIG. 4 shows the apparatus with the hood lifted. The combination of the container (not seen in FIG. 4), the fabric 12 and the hood 16 constitutes a bed, crib or bassinet.

Figure 5:
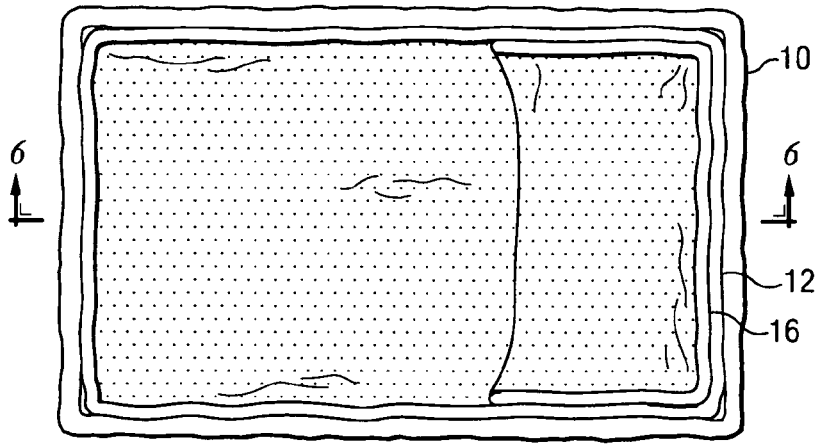
FIG. 5 is a plan view of a purse that converts into a doll bed according to one illustrative embodiment of the invention, with the fabric material that forms the cloth bag extending upwardly but shown without its frills and folds.
Figure 6:
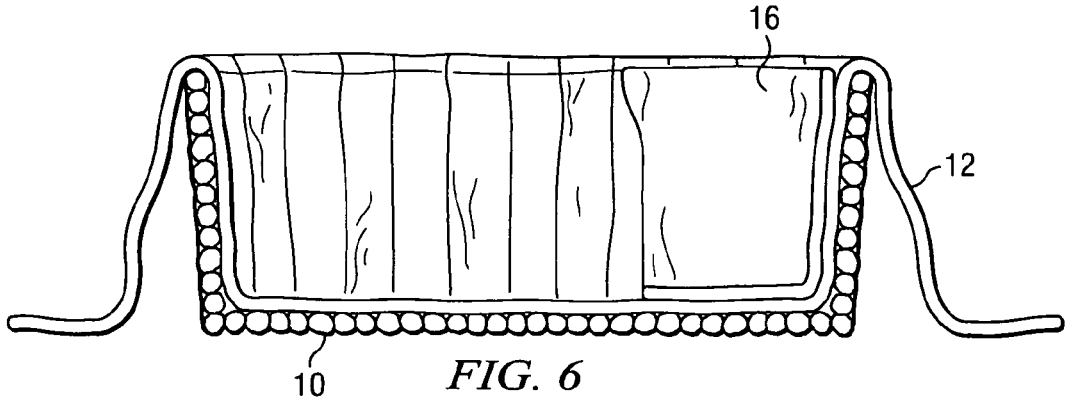
FIG. 6 is a side view of purse that converts into a doll bed according to one illustrative embodiment of the invention as seen from the line 6—6 in FIG. 5 with the fabric material that forms the cloth bag extending outwardly and down around the basket and the fabric hood mounted therein laying concave within the cloth bag.
Figure 7:
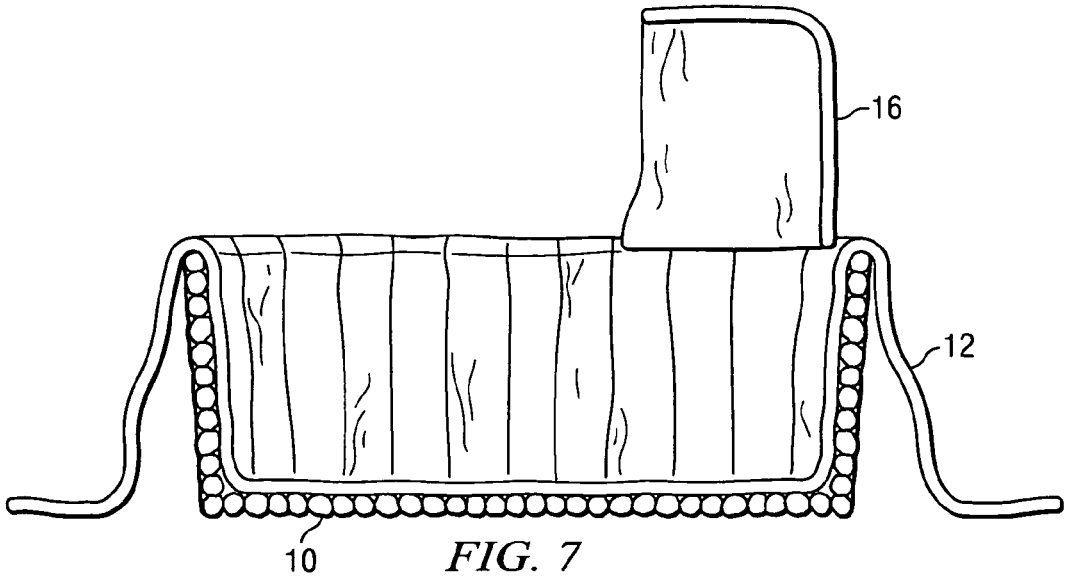
FIG. 7 is a side view of purse that converts into a doll bed according to one illustrative embodiment of the invention as shown in FIG. 6 with the fabric material that forms the cloth bag extending upwardly and the fabric hood mounted therein lifted to serve as a toy sunshade for the doll.

FIGS. 5, 6 and 7 provide further description with respect to the hood mounted within the apparatus at one end thereof. FIG. 5 is a plan view of the purse that may be converted to a doll bed according to this invention. The fabric bag 12 is shown mounted to and within the container or wicker basket 10. The fabric hood 16 is mounted within the fabric bag 12 at one end thereof. The fabric hood 16 ends along the length of the apparatus about as far as a hood extends for a baby bassinet. The concave inside of the apparatus is depicted as the area that is dotted.

FIG. 6 is a side view of the purse that may be converted to a doll bed according to this invention taken at line 6—6 in FIG. 5. As previously discussed, the fabric bag 12 is shown mounted to and within the wicker basket 10. Again, it should be appreciated that alternative fabric arrangements maybe employed as well. In this illustrative example, the fabric hood 16 is mounted within the fabric bag 12 at one end thereof. The fabric hood 16 ends along the length of the apparatus about as far as a hood extends for a baby bassinet. FIG. 6 shows the fabric hood 16 laying concave along the end and bottom of the apparatus. The fabric 12 is folded outwardly and downwardly around the container 10 to form a fabric skirt for the doll bed.

FIG. 7 is a modification of FIG. 6 showing the purse that may be converted to a doll bed according to this invention with the fabric hood 16 lifted to form a sun shade for the doll bed. As previously discussed, the fabric bag 12 is shown mounted to and within the wicker basket 10. The fabric hood 16 is mounted within the fabric bag 12 at one end thereof. The fabric hood 16 extends along the length of the apparatus about as far as a hood extends for a baby bassinet. FIG. 7 shows the fabric hood 16 lifted to a convex position operable, for example, to serve as a toy sunshade for the doll, the apparatus thereby constituting a crib or bassinet for the doll. The fabric 12 is folded outwardly and downwardly around the container 10 to form a fabric skirt for the bassinet.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An apparatus transformable between a purse and a doll bed, comprising:

an upwardly facing basket that is substantially closed on the bottom and the sides and provides an opening at the top thereof;

fabric fixed to the basket around the opening and extending upwardly from the basket opening, wherein the fabric extends upwardly to form a purse and folds outwardly and downwardly around the basket to form a doll bed;

a draw string secured to the fabric to close the open end of the fabric; and a flap secured at one end of the basket, which flap lays concave in the basket when the apparatus is formed into a purse and lifts to a convex position forming a bassinet-type hood when the apparatus is formed into a doll bed.

2. A purse transformable into a doll bed, comprising:

an upwardly facing container that is substantially closed on the bottom and the sides and provides an opening at the top thereof;

fabric mounted in the container which extends upwardly from the container opening wherein the fabric extends upwardly sufficiently so that the fabric may be used to form a purse or be folded outwardly to form a doll bed;

straps secured to the upper end of one of the fabric or the container serving as a means for carrying the purse; and a hood secured to the interior of the fabric which may lay concave when the fabric is formed into a purse and be lifted into a convex position to serve as a toy sunshade for a doll when the fabric is formed into a doll bed.

* * * * *